US011761630B2

(12) United States Patent
Jayarathne et al.

(10) Patent No.: US 11,761,630 B2
(45) Date of Patent: Sep. 19, 2023

(54) SYSTEMS AND METHODS FOR MONITORING OPERATION OF A FURNACE SYSTEM

(71) Applicant: Johnson Controls Tyco IP Holdings LLP, Milwaukee, WI (US)

(72) Inventors: Madhuka Manuranga Jayarathne, Wichita, KS (US); Andrew Michael Boyd, Wichita, KS (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 85 days.

(21) Appl. No.: 17/512,471

(22) Filed: Oct. 27, 2021

(65) Prior Publication Data

US 2022/0136698 A1 May 5, 2022

Related U.S. Application Data

(60) Provisional application No. 63/192,405, filed on May 24, 2021, provisional application No. 63/107,323, filed on Oct. 29, 2020.

(51) Int. Cl.
*F23N 5/24* (2006.01)
*F23N 5/16* (2006.01)

(52) U.S. Cl.
CPC ..... *F23N 5/242* (2013.01); *F23N 5/16* (2013.01); *F23N 2223/08* (2020.01); *F23N 2231/20* (2020.01); *F23N 2241/02* (2020.01)

(58) Field of Classification Search
CPC ..... F23N 5/16; F23N 5/242; F23N 2241/02; F23N 2231/20; F23N 2223/08
USPC ..... 431/6, 13, 75, 77
See application file for complete search history.

(56) References Cited

U.S. PATENT DOCUMENTS

| | | | | |
|---|---|---|---|---|
| 8,956,152 | B2 | 2/2015 | Cook | |
| 2010/0151397 | A1* | 6/2010 | Farrell | F23N 5/18 431/75 |
| 2014/0144156 | A1 | 5/2014 | Lang et al. | |
| 2022/0349579 | A1* | 11/2022 | Carroll | F23N 5/242 |

OTHER PUBLICATIONS

Lackner, M. "Tunable Diode Laser Absorption Spectroscopy (TDLAS) in the Process Industries—A Review". Reviews in Chemical Engineering. Apr. 2007 (Year: 2007).*

* cited by examiner

*Primary Examiner* — Vivek K Shirsat
(74) *Attorney, Agent, or Firm* — Fletcher Yoder, P.C.

(57) ABSTRACT

A furnace system of a heating, ventilation, and/or air conditioning (HVAC) system includes a burner assembly having a burner enclosure configured to receive a fuel for ignition to generate heated combustion byproducts. The furnace system also includes a controller configured to detect a value associated with a wave signal transmitted through the burner enclosure and operate the furnace system based on a comparison between the value and a threshold value.

18 Claims, 7 Drawing Sheets

SYSTEMS AND METHODS FOR MONITORING OPERATION OF A FURNACE SYSTEM

CROSS-REFERENCE TO RELATED APPLICATIONS

This application claims priority from and the benefit of U.S. Provisional Application No. 63/107,323, entitled "SENSING A FLAME," filed Oct. 29, 2020, and U.S. Provisional Application No. 63/192,405, entitled "A FURNACE SYSTEM FOR DETECTION OF FLAME AND A METHOD THEREOF," filed May 24, 2021, each of which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. In some embodiments, the HVAC system may include a furnace system configured to heat the supply air flow. As an example, the furnace system may include a burner assembly configured to ignite a fuel to produce a flame. Unfortunately, it may be difficult to monitor different parameters associated with the furnace system, such as parameters indicative of an operation of the burner assembly.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a furnace system of a heating, ventilation, and/or air conditioning (HVAC) system includes a burner assembly having a burner enclosure configured to receive a fuel for ignition to generate heated combustion byproducts. The furnace system also includes a controller configured to detect a value associated with a wave signal transmitted through the burner enclosure and operate the furnace system based on a comparison between the value and a threshold value.

In one embodiment, a non-transitory computer-readable medium includes instructions stored thereon. The instructions, when executed by processing circuitry, are configured to cause the processing circuitry to receive data associated with detection of a wave signal transmitted through a burner assembly of a furnace system, determine an operating parameter of the furnace system based on the data, and operate the furnace system based on the operating parameter.

In one embodiment, a furnace system includes a burner enclosure forming an internal volume, a transmitter coupled to the burner enclosure and configured to output a wave signal into the burner enclosure, a receiver coupled to the burner enclosure and configured to receive the wave signal output by the transmitter, and a controller communicatively coupled to the receiver and to the transmitter. The controller is configured to receive data from the receiver, the data including a property value associated with the wave signal, and operate the furnace system based on the property value.

BRIEF DESCRIPTION OF THE DRAWINGS

Various aspects of this disclosure may be better understood upon reading the following detailed description and upon reference to the drawings in which.

DETAILED DESCRIPTION

Figure 1:
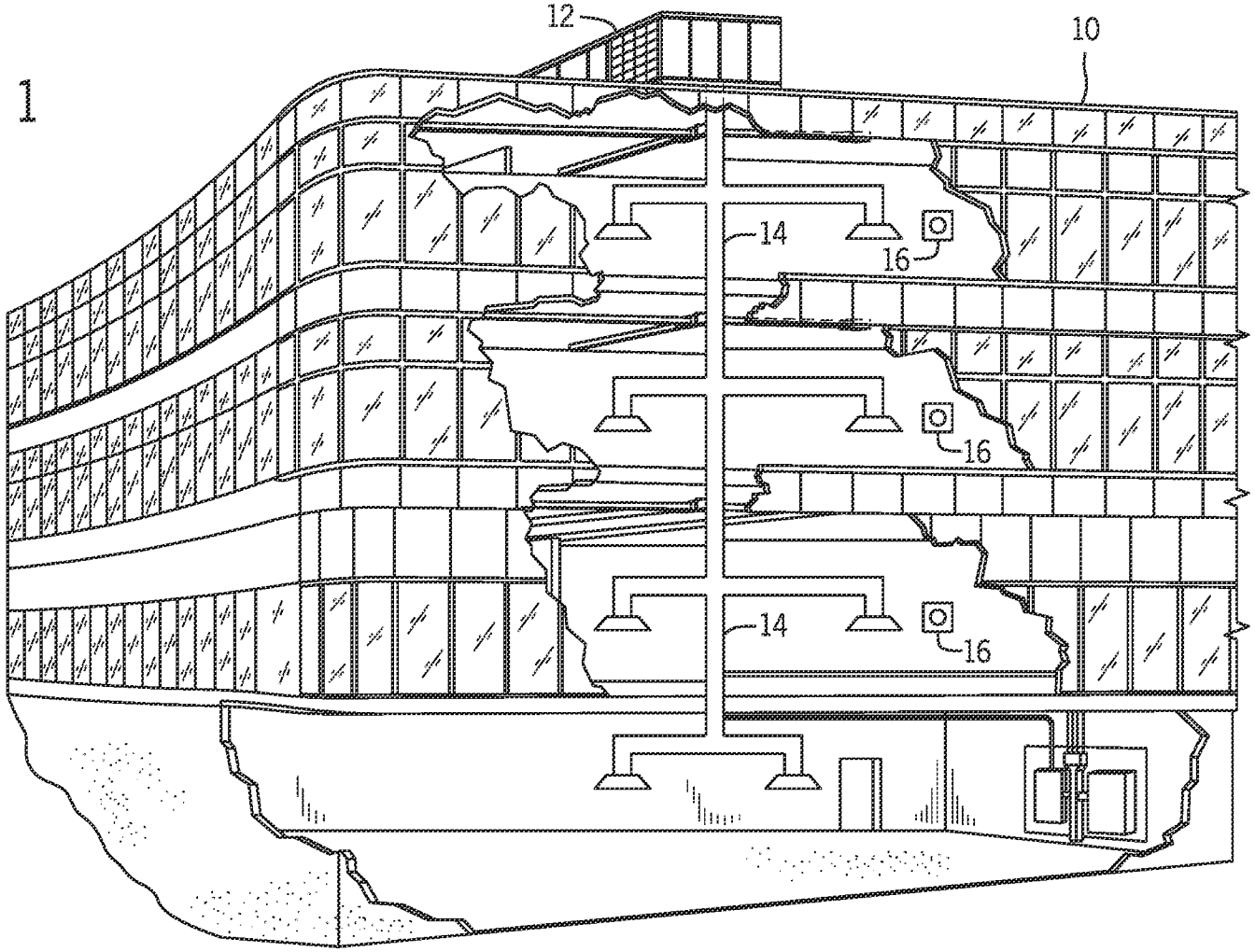
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. The HVAC system may be configured to condition a supply air flow and deliver the conditioned supply air flow to a space to condition the space. For example, the HVAC system may be configured to cool, heat, and/or dehumidify the supply air flow. In some embodiments, the HVAC system may include a furnace system configured to heat the supply air flow. For instance, the furnace system may include a burner assembly configured to ignite fuel (e.g., a fuel/oxidizer mixture) to produce heated combustion byproducts, which may be directed through a heat exchanger. A fan may direct the supply air flow across the heat exchanger, and the heat exchanger may place the supply air flow in a heat exchange relationship with the heated combustion byproducts to heat the supply air flow. The heated supply air flow may then be directed to the space to heat the space.

It may be desirable to monitor different operating parameters associated with the furnace system to determine whether the furnace system is operating desirably. As an example, it may be desirable to determine whether the burner assembly is operating to heat the supply air flow. Unfortunately, it may be difficult to monitor certain operating parameters associated with the burner assembly. For instance, a sensor (e.g., a contact sensor) positioned within a burner enclosure of the burner assembly may deteriorate or degrade over time, and measurements determined by the sensor may therefore be unreliable, unavailable, and/or inaccurate. As such, it may be difficult to monitor the operation of the burner assembly, such as to determine an undesirable or faulty operation of the burner assembly. Thus, an action to mitigate the operation of the burner assembly may not be performed, and operation of the furnace system may be impacted.

Thus, it is presently recognized that monitoring the operation of the burner assembly in a more reliable and/or accurate manner may improve the operation of the furnace system. Accordingly, embodiments of the present disclosure are directed to monitoring a wave signal (e.g., a sound or audio wave signal) transmitted through the burner enclosure and operating a furnace system based on the wave signal. As an example, a first opening and a second opening may be formed through the burner enclosure. A transmitter may be configured to output a wave signal into the burner enclosure via the first opening and direct the wave signal toward the second opening. A receiver may be configured to receive the wave signal from the burner enclosure via the second opening. The receiver may transmit data associated with the wave signal to a control system, and the control system may determine a value associated with the wave signal, such as a value of a property of the wave signal and/or a value of an operating parameter of the furnace system indicated by the wave signal. The value associated with the wave signal may be indicative of the operation of the burner assembly. For example, the operation of the burner assembly (e.g., a temperature within the burner enclosure) may affect, impact, establish, or modify a property, such as a frequency, amplitude, wavelength, and/or strength, of the wave signal. The value may be indicative of, derived from, and/or calculated based on the property of the wave signal. The operation of the burner assembly may affect the value associated with the wave signal, and the value may therefore be used to evaluate the operation of the burner assembly.

For instance, the control system may compare the value to a range of values (e.g., a range of property values of the wave signal, a range of operating parameter values associated with the furnace system) and perform an action based on the comparison. As an example, in response to a determination that the value is within the range of values to indicate that the furnace system may be operating desirably, the control system may continue a current operation of the furnace system. In response to a determination that the value is outside the range of values to indicate that the furnace system may not be operating desirably, the control system may adjust operation of the furnace system, output a notification, and/or suspend operation of the furnace system. For example, the value being within the range of values may indicate whether a flame is present within the burner enclosure (e.g., to indicate that fuel is being properly ignited), a temperature within the burner enclosure, and/or a quality of fuel used by the burner enclosure. The operation of the burner assembly may not substantially affect the operation and/or structural integrity of the transmitter and/or receiver. Thus, the transmitter and/or receiver may operate more reliably, accurately, and/or durably than other types of sensors, such as contact temperature sensors, and may have a longer useful life than other traditional sensors. As such, the operation of the burner assembly may be more readily and/or accurately determined. For example, a faulty operation of the burner assembly (e.g., absence of a flame during operation of the burner assembly, a temperature of the flame being below a desirable level) may be determined and therefore addressed more quickly and/or accurately. As a result, the operation of the furnace system may be also be more readily and/or accurately determined and/or improved.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
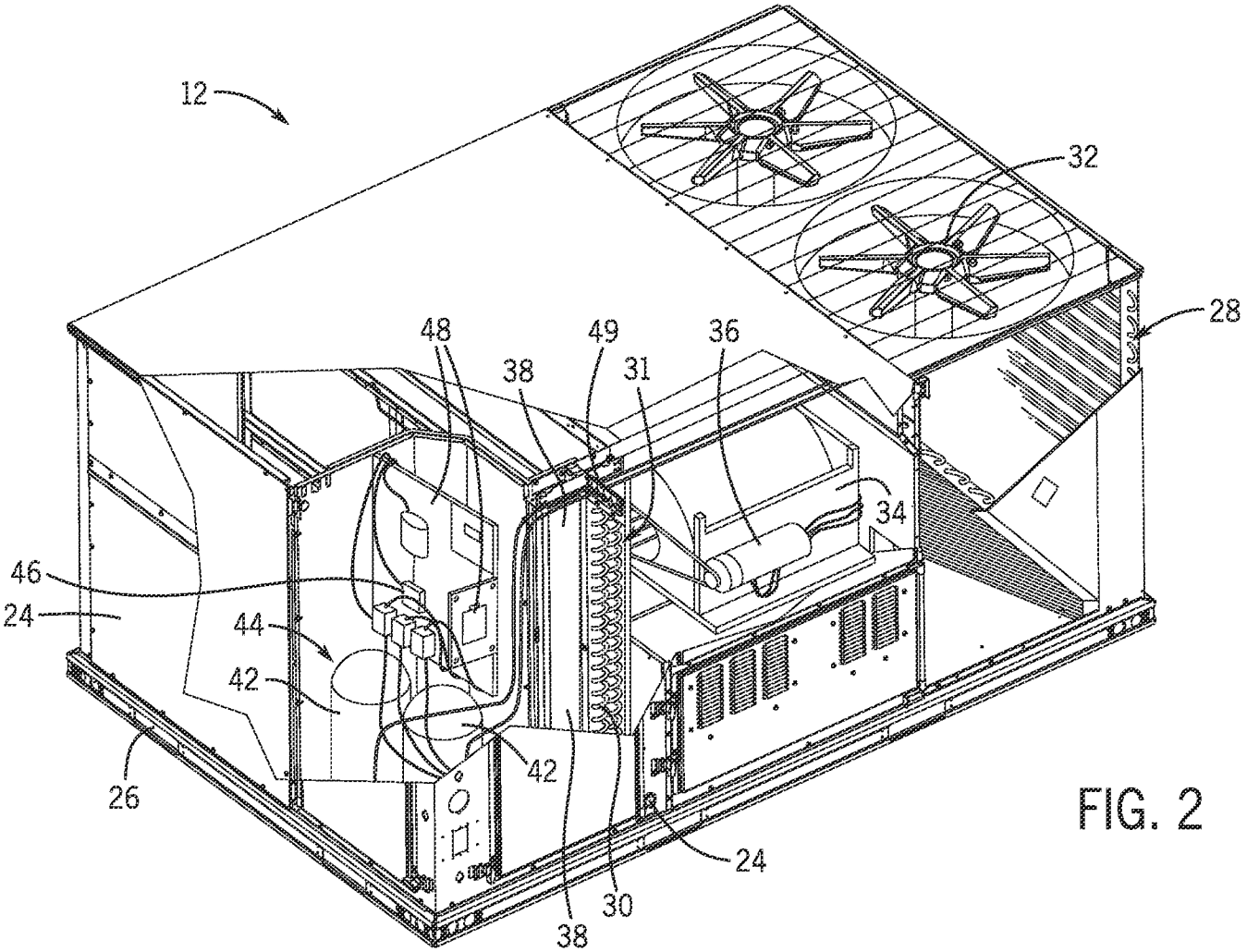
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
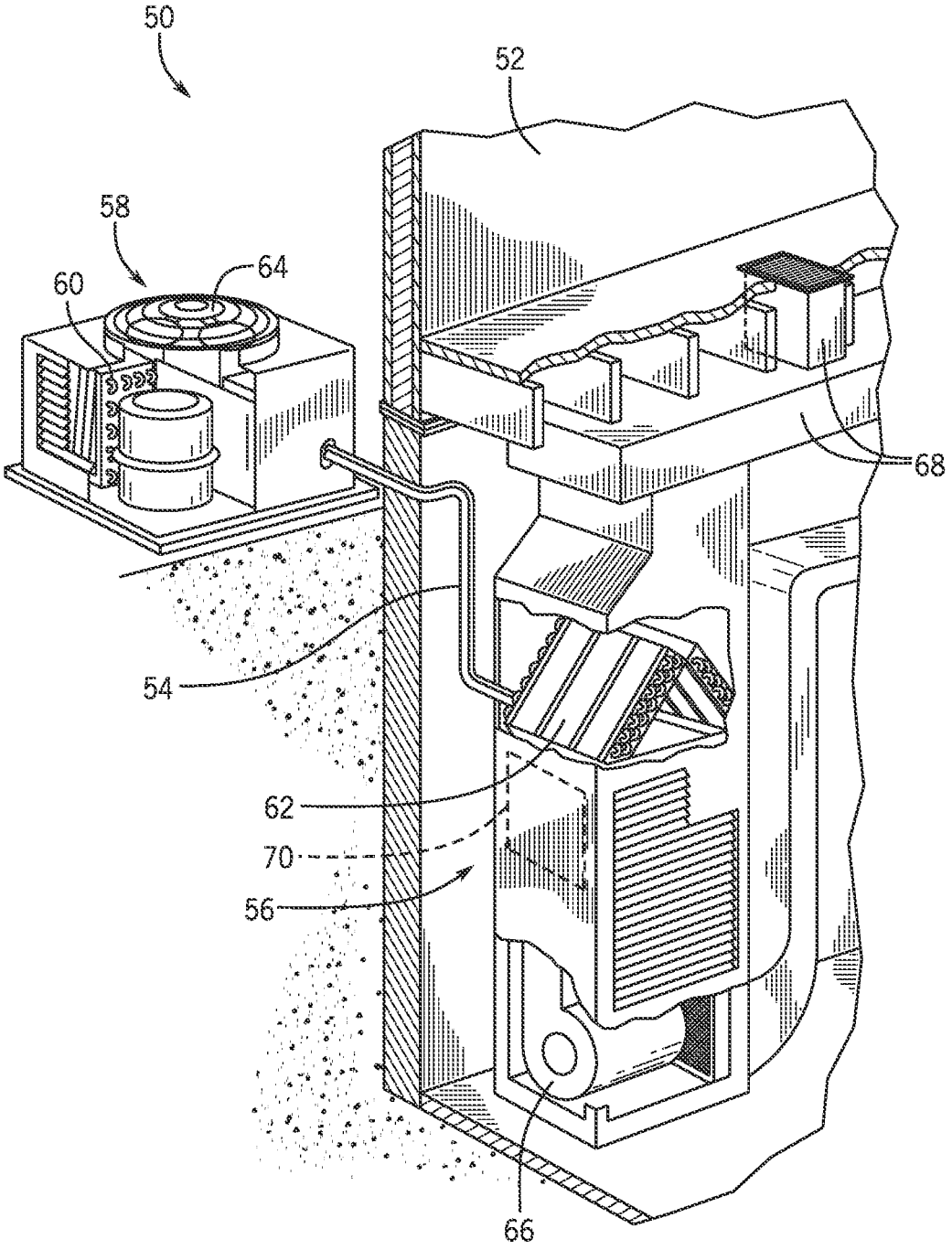
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion byproducts. The combustion byproducts may pass through tubes or piping in a heat exchanger, separate from heat exchanger 62, such that air directed by the blower 66 passes over the tubes or pipes and extracts heat from the combustion byproducts. The heated air may then be routed from the furnace system 70 to the ductwork 68 for heating the residence 52.

Figure 4:
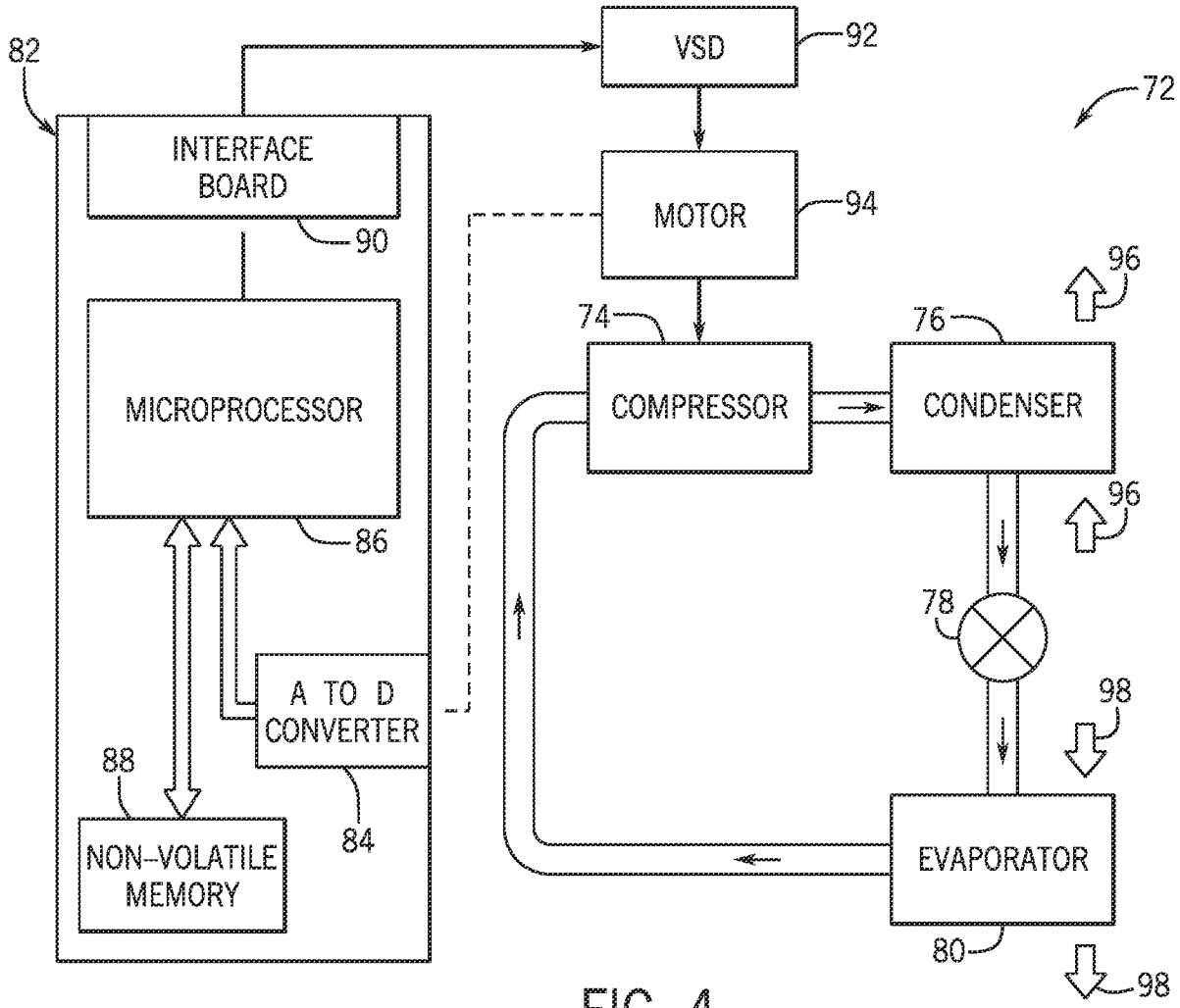
FIG. 4 is a schematic diagram of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to systems and methods utilizing a wave signal (e.g., an acoustic wave) to determine an operating parameter of a furnace system, such as whether a flame is being generated during operation of the furnace system. The furnace system may include a burner assembly to function as a heat source. The wave signal may be generated and directed through a burner enclosure of the burner assembly, and the operation of the burner assembly may affect (e.g., modify) a property of the wave signal. A value associated with the affected property of the wave signal may be determined in order to evaluate the operation of the burner assembly. For example, the value may be compared with a threshold value and/or a range of values to determine whether the burner assembly and therefore the furnace system are operating desirably (e.g., a fuel is being ignited to produce a flame). Although the present disclosure primarily focuses discussion on a furnace system of a residential heating and cooling system, the techniques described herein may be incorporated in any suitable heating system, such as a heating system for an RTU, a standalone heating system, or other HVAC heating system.

Figure 5:
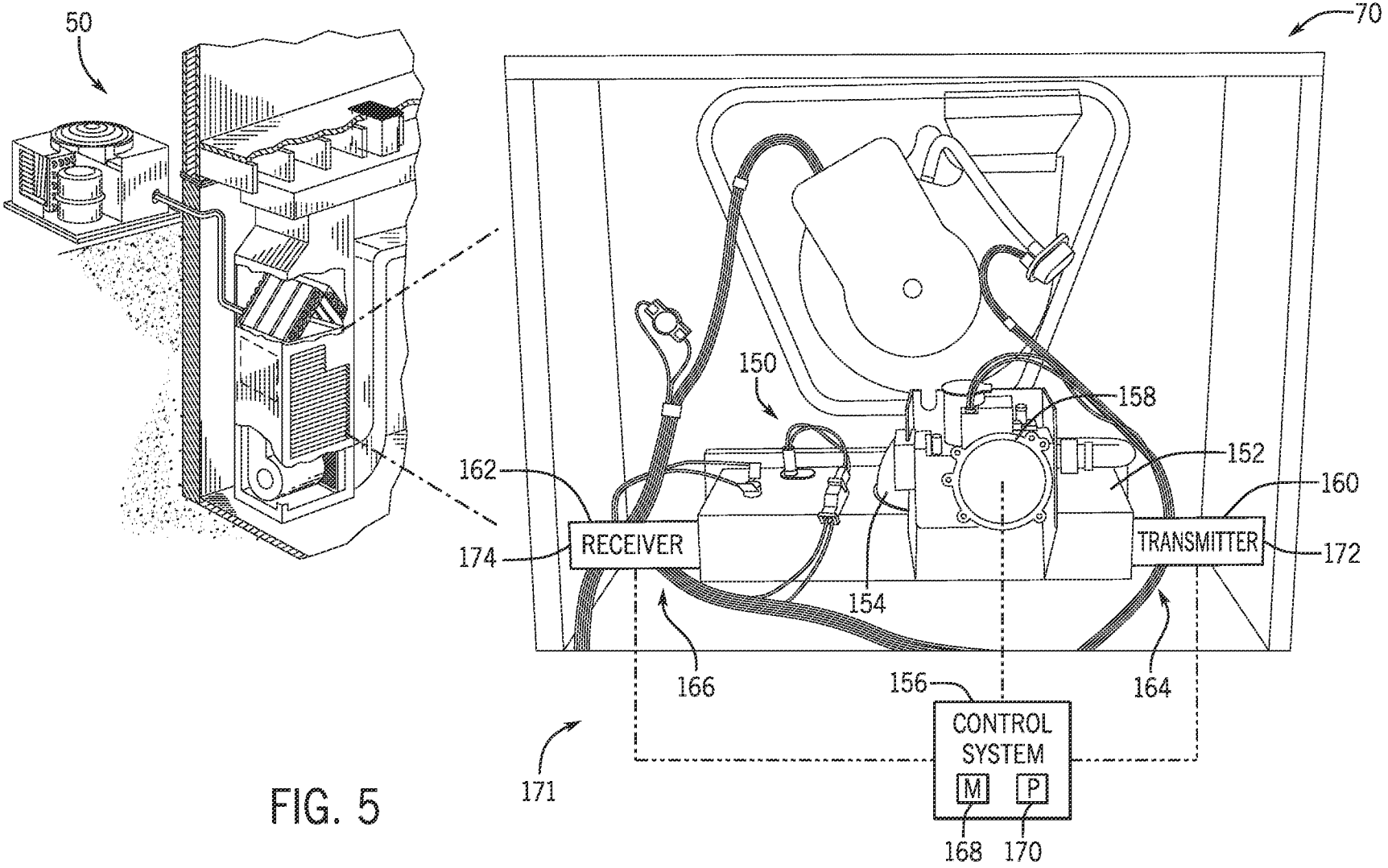
FIG. 5 is a perspective view of an embodiment of a furnace system of an HVAC system, in accordance with an aspect of the present disclosure.

With this in mind, FIG. 5 is a perspective view of an embodiment of the furnace system 70 configured to heat an air flow. The furnace system 70 may be a gas furnace system and may therefore include a burner assembly 150 as the heat source for generating and providing heat. In some embodiments, the burner assembly 150 may include a burner enclosure, housing, or box 152. During operation of the burner assembly 150, the burner enclosure 152 may be configured to receive fuel (e.g., natural gas, oil) from a fuel source (e.g., a gas line) via a conduit 154. In some embodiments, the burner assembly 150 may include a premix burner assembly, and the fuel received by the burner enclosure 152 may include a mixture of fuel and an oxidizer (e.g., air) to facilitate establishing a uniformity of a flame generated based on ignition of the fuel/oxidizer mixture. As an example, the fuel/oxidizer mixture within the burner enclosure 152 may be ignited via a spark, which may be provided by a component of the burner assembly 150, such as a pilot light, an electronic igniter, and/or a hot surface igniter. Ignition of the fuel/oxidizer mixture may produce heated combustion byproducts within an internal volume of the burner enclosure 152. The burner assembly 150 may be fluidly coupled to a heat exchanger (not shown) of the furnace system 70, and the heated combustion byproducts may be directed through the heat exchanger via a fan (e.g., a draft inducer blower). An air flow may be directed across the heat exchanger, and heat may transfer from the combustion byproducts directed through the heat exchanger to the air flow directed across the heat exchanger, thereby heating the air flow. The air flow may then be directed to a space serviced by the furnace system 70 to heat the space.

The furnace system 70 may also include a control system 156 (e.g., an automation controller, a programmable controller). The control system 156 may be configured to control operation of the furnace system 70, such as by adjusting a valve 158 to direct fuel/oxidizer mixture into the burner enclosure 152 to enable the burner assembly 150 to provide heating capabilities for the furnace system 70. The control system 156 may also be configured to determine one or more operating parameters associated with the furnace system 70. For example, the control system 156 may be configured to monitor an operation of the burner assembly 150, such as an operation associated with ignition of the fuel/oxidizer mixture within the burner enclosure 152. Indeed, the control system 156 may determine whether the burner assembly 150 is operating desirably, such as that a flame is being generated by igniting the fuel/oxidizer mixture, a parameter associated with the generated flame, and/or a parameter of the fuel/oxidizer mixture received by the burner enclosure 152, based on the operating parameter(s) to control operation of the furnace system 70.

To this end, the burner assembly 150 may include a transmitter 160 (e.g., an emitter, a transducer, a generator, a speaker, a diode) configured to generate and output a wave signal and direct the wave signal through the burner enclosure 152. The burner assembly 150 may also include a receiver 162 (e.g., a transducer, a sensor, a detector, a microphone) configured to receive the wave signal output by the transmitter 160 after the wave signal is directed through the burner enclosure 152. For example, an interior volume of the burner enclosure 152 may be exposed to each of the transmitter 160 and the receiver 162. The transmitter 160 may output the wave signal through the interior volume, and the receiver 162 may receive the wave signal transmitted through the interior volume. In some embodiments, the wave signal output by the transmitter 160 may include an acoustic or sound wave, which may be an inaudible sound wave (e.g., an ultrasonic sound wave, an infrasonic sound wave) and/or an audible sound wave. In additional or alternative embodiments, the wave signal may include a different type of signal, such as an electromagnetic wave (e.g., a light wave), light amplification by stimulated emission of radiation (laser), and so forth. Indeed, any suitable wave signal may be used, such as a pulsed wave signal, a frequency modulated wave signal, an amplitude modulated wave signal, and the like.

In the illustrated embodiment, the transmitter 160 is positioned at a first side 164 of the burner enclosure 152, and the receiver 162 is positioned at a second side 166, opposite the first side 164, of the burner enclosure 152. For example, the transmitter 160 and the receiver 162 may face toward one another. As such, the transmitter 160 may output the wave signal toward the receiver 162 to facilitate receipt of the wave signal via the receiver 162 after the wave signal travels through the burner enclosure 152. In such embodiments, the burner enclosure 152 (e.g., the sides 166, 164) may include and/or be formed from an absorptive or insulating material to block deflection of waves output by the transmitter 160 and reduce interference of waves between one another. However, in additional or alternative embodiments, the receiver 162 and the transmitter 160 may be positioned in any suitable orientation relative to one another, such as at a common side and/or at adjacent sides of the burner assembly 150. Indeed, the transmitter 160 and the receiver 162 may not face toward one another in some embodiments. By way of example, the wave signal output by the transmitter 160 may deflect off the burner enclosure 152 before receipt by the receiver 162. In such embodiments, the burner enclosure 152 may include and/or be formed from a material configured to facilitate deflection of the waves output by the transmitter 160 toward the receiver 162. Furthermore, although the illustrated burner assembly 150 includes a single transmitter 160 and receiver 162, the burner assembly 150 may additionally or alternatively include multiple transmitters 160 and/or multiple receivers 162 (e.g., a different number of transmitters 160 relative to the number of receivers 162) to direct and receive multiple wave signals within the burner enclosure 152. In further embodiments, the burner assembly 150 may include one or more transceivers configured to perform both wave signal output and receipt functionalities. For example, a single transceiver may be configured to output a wave signal within the burner enclosure 152, and the wave signal may deflect off the burner enclosure 152 (e.g., an internal wall within the burner enclosure 152) and receive the wave signal deflected off the burner enclosure 152.

In certain embodiments, each of the transmitter 160 and the receiver 162 may be positioned external to the burner enclosure 152. Thus, elements or conditions within the burner enclosure 152 may have a limited impact on the operation of the transmitter 160 and/or the receiver 162. For example, an increased temperature and/or a flame within the burner enclosure 152 may not significantly affect the transmitter 160 and/or the receiver 162 positioned external to the burner enclosure 152. Therefore, positioning the transmitter 160 and/or the receiver 162 external to the burner enclosure 152 may increase a reliability, an accuracy, and/or a longevity of the transmitter 160 and/or the receiver 162.

Moreover, each of the transmitter 160 and the receiver 162 may be enclosed by a casing, cover, shell, or jacket. That is, a first casing 172 may enclose the transmitter 160, and a second casing 174 may enclose the receiver 162. The transmitter 160 and the receiver 162 may be secured to the casings 172, 174, respectively, and the casings 172, 174 may be secured to the burner enclosure 152 in order to block relative movement between the burner enclosure 152, the transmitter 160, and/or the receiver 162. The casings 172, 174 may retain a position of the transmitter 160 and/or the receiver 162 external to the burner enclosure 152. In some embodiments, the casings 172, 174 may offset the transmitter 160 and/or the receiver 162 from the burner enclosure 152 and therefore block direct contact between the transmitter 160 and the burner enclosure 152 and/or between the receiver 162 and the burner enclosure 152. Thus, the casings 172, 174 may block direct heat transfer from the burner enclosure 152 to the transmitter 160 and/or the receiver 162, thereby blocking an elevated temperature of the burner enclosure 152 from impacting the transmitter 160 and/or the receiver 162. The casings 172, 174 may additionally shield components, such as internal structure and/or circuitry, of the transmitter 160 and the receiver 162, respectively. For instance, the casings 172, 174 may also block external elements, such as debris, from contacting the transmitter 160 and/or the receiver 162, thereby further protecting the transmitter 160 and/or the receiver 162.

The control system 156 may be configured to monitor a property associated with the wave signal received by the receiver 162. To this end, the control system 156 may include a memory 168 and processing circuitry 170. The memory 168 may include a non-transitory computer-readable medium that may include volatile memory, such as random-access memory (RAM), and/or non-volatile memory, such as read-only memory (ROM), flash memory, optical drives, hard disc drives, solid-state drives, or any other suitable non-transitory computer-readable medium storing instructions that, when executed by the processing circuitry 170, may control operation of the furnace system 70. To this end, the processing circuitry 170 may include one or more application specific integrated circuits (ASICs), one or more field programmable gate arrays (FPGAs), one or more programmable logic devices (PLD), one or more programmable logic arrays (PLA), one or more general purpose processors, or any combination thereof configured to execute such instructions. The arrangement of the control system 156 having the memory 168 and the processing circuitry 170, along with the transmitter 160 and the receiver 162 may be collectively form or be a part of a wave signal control assembly 171 configured to output the wave signal through the burner enclosure 152, receive the wave signal traveling through the burner enclosure 152, analyze the received wave signal, and operate the furnace based on received wave signal.

For example, in some embodiments, the control system 156 may operate the furnace system 70 based on analysis of the wave signal captured by the receiver 162 from the transmitter 160. For instance, the control system 156 may receive data indicative of a property of the wave signal captured by the receiver 162, the control system 156 (e.g., data interpretation circuitry of the processing circuitry 170) may process the data to determine a value associated with the wave signal, and the control system 156 may operate the furnace system 70 based on the value. The data may indicate a frequency, amplitude, wavelength, speed, and/or strength of the wave signal, and the control system 156 may include arithmetical and/or logical operations to process the data to determine the value. By way of example, during operation of the furnace system 70, the transmitter 160 may output a wave signal having a predetermined, preset, or known property (e.g., a first property value). A condition or operation (e.g., an elevated temperature, a flame, the input fuel/oxidizer mixture) of the burner enclosure 152 may adjust the property of the wave signal transmitted through the burner enclosure 152 (e.g., to a second property value), and the receiver 162 may receive the wave signal having the adjusted property. As an example, an increase in temperature may modify (e.g., decrease) the wavelength, modify (e.g., increase) the frequency, and/or modify (e.g., increase) the amplitude of the wave signal as the wave signal is transmitted through the burner enclosure 152. For instance, the property of the wave signal detected by the receiver 162 may indicate whether a flame is present within the burner enclosure 152 to increase the temperature within the burner enclosure 152. As another example, a detected property of the wave signal may indicate that a temperature is maintained within the burner enclosure 152 (e.g., to indicate ignition of a fuel/oxidizer mixture), but certain properties (e.g., a speed) of the wave signal may nonetheless be adjusted. Such circumstances may indicate a change in composition of the fuel/oxidizer mixture, such as a presence of a fuel/oxidizer mixture leak and/or contamination within the fuel/oxidizer mixture.

In certain embodiments, the data received from the receiver 162 may directly include a property value, such as a frequency value, a wavelength value, an amplitude value, a speed value, and/or a strength value, of the wave signal. In additional or alternative embodiments, the data may include information that is used by the control system to determine, calculate, or derive the property value of the wave signal. For example, the data may indicate a time duration in which the wave signal travels from the transmitter 160, across the burner enclosure 152, and to the receiver 162. The control system 156 may calculate the speed of the wave signal based on the time duration, such as by dividing a distance between the transmitter 160 and the receiver 162 by the time duration.

In further embodiments, an operating parameter of the furnace system 70 may be determined based on the property value of the wave signal. The operating parameter may include, for instance, a presence of a flame within the burner enclosure 152, a temperature within the burner enclosure 152, an amount of the fuel/oxidizer mixture within the burner assembly 150, a flow rate of the fuel/oxidizer mixture directed into the burner enclosure 152, a richness, quality, or composition of the fuel/oxidizer mixture (e.g., a ratio value of fuel to oxidizer), a flame speed, a burning velocity, an upper flammability limit, a lower flammability limit, a flame period, a flame length, a flame position, a flame shape or geometry, a heat flux, a flame angle, a redox characteristic of a flame, and the like. By way of example, data or information (e.g., an equation, a formula, a database table) associating operating parameter values of the furnace system 70 with respective property values of the wave signal may be stored in the memory 168 of the control system 156, and the control system 156 may refer to the data to determine an operating parameter value corresponding to the property value indicated by the data received from the receiver 162. In some embodiments, the operating parameter may correspond to the property value of the received wave signal. Additionally or alternatively, the operating parameter may correspond to a difference between the property value of a received wave signal relative to the property value of a transmitted wave signal. That is, the operating parameter may be determined based on a change of the property value of the wave signal as the wave signal travels through the burner enclosure 152.

In a non-limiting example, the control system 156 may use Equation 1 shown below to determine the temperature value within the burner enclosure 152.

$$V_S=\sqrt{\gamma RT/M} \qquad \text{Equation 1}$$

in which R is the universal gas constant, T is the absolute temperature in Kelvin, M is the molecular mass of the fuel/oxidizer mixture in kilograms per mole, $\gamma$ is the adiabatic constant, and $V_S$ is the velocity of the wave signal. However, any other suitable equation, data, or information associating the temperature within the burner enclosure 152 to various property values of the wave signal may be used in additional or alternative embodiments. Furthermore, any other information may be used to determine a different operating parameter value. For example, information may be referenced and/or a method for processing the data received from the receiver 162 may be performed based on the type of the operating parameter value to be determined, the property value of the wave signal determined by the receiver 162 and/or indicated by the data, a user input (e.g., indicative of using a particular method to process the data), and so forth.

In some embodiments, the control system 156 may compare the property value of the wave signal to a range of property values indicative of a desirable, expected, and/or target operation of the burner assembly 150 (e.g., a flame is generated within the burner enclosure 152, the fuel/oxidizer mixture within the burner enclosure 152 is desirable). In additional or alternative embodiments, the control system 156 may determine the operating parameter value based on property value of the wave signal to a range of operating parameter values indicative of the desirable operation of the burner assembly 150. In either case, the control system 156 (e.g., the data interpretation circuitry) may determine a value associated with the wave signal, and the control system 156 (e.g., data evaluation circuitry of the processing circuitry 170) may compare the value with a range of values, which may be stored in the memory 168 (e.g., via a user input). As an example, the range of values may include a high threshold value and a low threshold value, as well as intermediate values between the high threshold value and the low threshold value, and the control system 156 may determine whether the value associated with the wave signal is below the high threshold value, above the low threshold value, included by one of the intermediate values, or otherwise within the range of values.

In response to a determination that the value is outside of the range of values to indicate that the operation of the burner assembly 150 may not be desirable, the control system 156 may output an additional control signal, such as to transmit a notification to a user (e.g., to a mobile device of the user, such as a computing device, a mobile phone, a laptop computer, a desktop computer, a tablet) and/or adjust operation of the furnace system 70. As an example, the value being outside of the range of values may indicate that a flame is not being generated within the burner enclosure 152 (e.g., based on a temperature within the burner enclosure 152 being below a threshold temperature as indicated by the value associated with the wave signal) during the operation of the furnace system 70. As such, the burner assembly 150 may not be providing heating capabilities. As another example, the value being outside of the range of values may indicate that although a flame is being generated within the burner enclosure 152, a characteristic of the flame and/or a fuel being ignited to generate the flame is undesirable or unsuitable. For instance, the temperature within the burner enclosure 152 may be insufficient, a quality of the fuel/oxidizer mixture received by the burner enclosure may be reduced, and/or a composition of the fuel/oxidizer mixture within the burner enclosure 152 may be undesirable. Thus, the control system 156 may operate to mitigate the undesirable operation of the burner assembly 150 in response to a determination that the value is outside of the range of values, such as by adjusting a flow rate of the fuel/oxidizer mixture directed into the burner enclosure 152, adjusting a composition of the fuel/oxidizer mixture, and/or suspending operation of the furnace system 70.

In some embodiments, the range of values (e.g., the range of operating parameter values of the furnace system 70, the range of property values of the wave signal) may be predetermined and established prior to operation of the furnace system 70. For example, the range of values may be determined during manufacture of the furnace system 70 based on the predetermined or preset property of the wave signal output by the transmitter 160 and/or a structure of the furnace system 70 (e.g., of the burner assembly 150). In additional or alternative embodiments, the range of values may be determined via a calibration mode of the furnace system 70. By way of example, during the calibration mode, the furnace system 70 may be operated in accordance with various desirable operations, and the values associated with the desirable operations may be recorded (e.g., via sensors dedicated to determine the values during the calibration mode) to establish the range of values.

The control system 156 may also be communicatively coupled to the transmitter 160 and may be configured to control operation of the transmitter 160. As an example, in response to an indication to operate the furnace system 70, such as based on a received call for heating, the control system 156 may initiate operation of the furnace system 70 (e.g., by opening the valve 158 to enable flow of fuel/ oxidizer mixture into the burner enclosure 152), initiate operation of the transmitter 160 to output the wave signal, and initiate operation of the receiver 162 to capture the wave signal output by the transmitter 160. For instance, in some embodiments the control system 156 may include signal generation circuitry configured to determine properties of the wave signal to be output by the transmitter 160. The properties of the wave signal may, for example, be determined based on a user input and/or stored in the memory 168 of the control system 156. The control system 156 may provide the properties of the wave signal to the transmitter 160 during operation of the furnace system 70 to cause the transmitter 160 to output a corresponding wave signal. During the operation of the furnace system 70, the control system 156 may continually cause the transmitter 160 to output wave signals and continually cause the receiver 162 to transmit data indicative of the received wave signals. Thus, the control system 156 may continually receive data from the receiver 162 to monitor the operation of the burner assembly 150. For example, the control system 156 may cause the transmitter 160 to output dozens, hundreds, or thousands of wave signals per second and correspondingly receive data indicative of the wave signals output by the transmitter 160. The control system 156 may determine respective values associated with each of the wave signals and operate based on comparisons between the respective values and the range of values.

Furthermore, in response to a determination that the furnace system 70 is no longer to be operated, such as based on an indication that a call for heating has been satisfied, the control system 156 may be configured to suspend operation of the furnace system 70 and also to suspend operation of the transmitter 160 and/or the receiver 162. In this manner, the control system 156 may suspend operation of the transmitter 160 and/or the receiver 162 while the burner assembly 150 is not in operation, such as while burner enclosure 152 does not receive the fuel/oxidizer mixture and/or while the fuel/oxidizer mixture is not ignited. As such, the control system 156 may block constant operation of the transmitter 160 and/or the receiver 162 to reduce energy consumption associated with operation of the transmitter 160 and/or the receiver 162.

In additional or alternative embodiments, the control system 156 may be configured to operate the transmitter 160 and the receiver 162 based on a user input. For example, the user input may be a manual input requesting operation of the transmitter 160 and the receiver 162 and/or suspension of the operation of the transmitter 160 and the receiver 162. In such embodiments, the control system 156 may be configured to operate the transmitter 160 and the receiver 162 independently from operation of the burner assembly 150.

Figure 6:
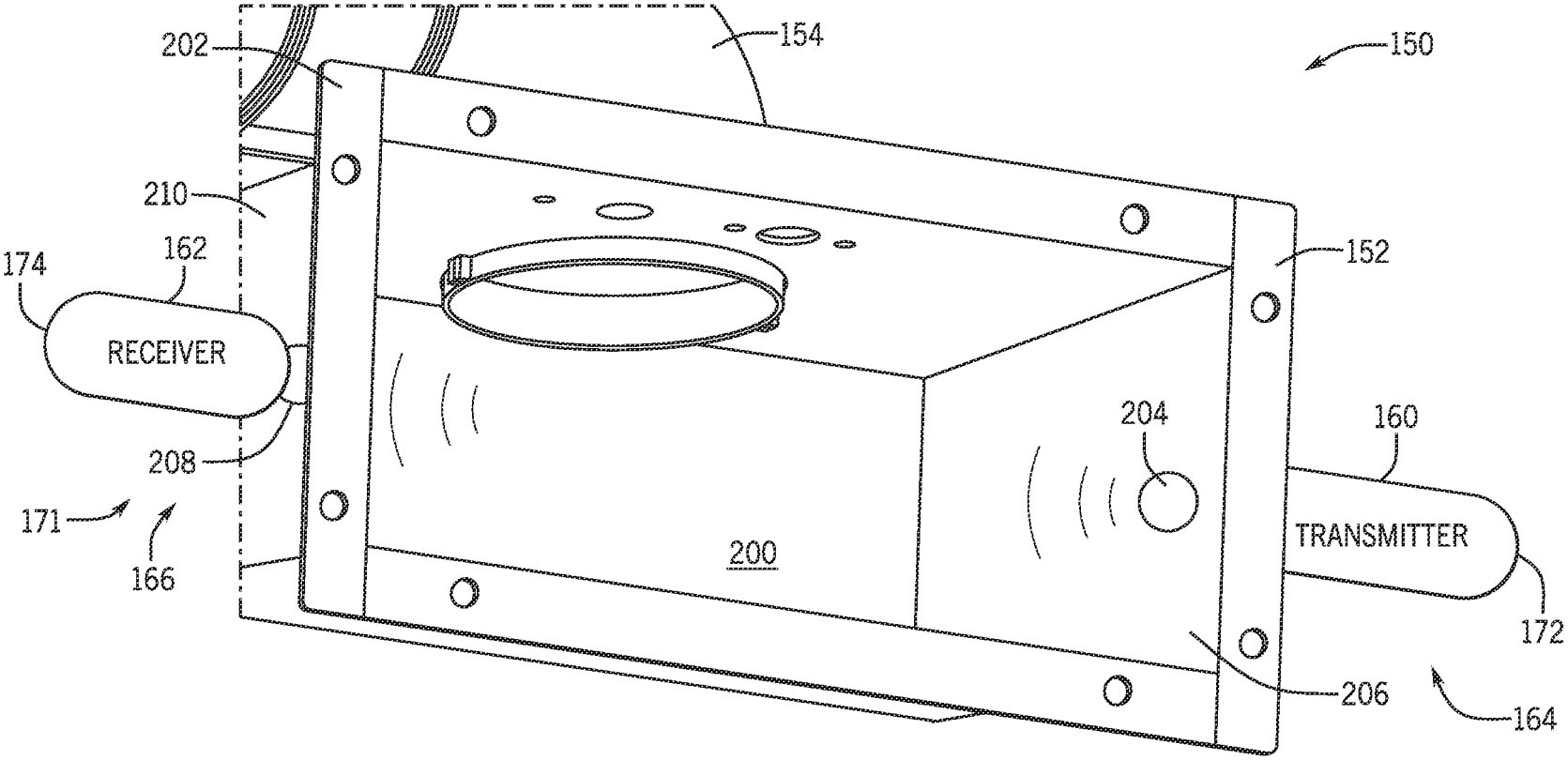
FIG. 6 is a perspective view of an embodiment of a burner assembly of a furnace system, in accordance with an aspect of the present disclosure.

FIG. 6 is a perspective view of an embodiment of the burner assembly 150 having the transmitter 160 and the receiver 162 of the wave signal control assembly 171. The burner enclosure 152 of the burner assembly 150 may form an internal volume 200 configured to receive fuel/oxidizer mixture via the conduit 154. The fuel/oxidizer mixture may be ignited within the internal volume 200 to produce the heated combustion byproducts. The internal volume 200 may be fluidly coupled to a heat exchanger to enable the heated combustion byproducts to be directed through the heat exchanger, such as through tubing of the heat exchanger. As an example, the burner enclosure 152 may include flanges 202 configured to couple to (e.g., secure to, mount to) the heat exchanger to enable the combustion byproducts to flow from the internal volume 200 into the heat exchanger, such as via a blower drawing an air flow from the internal volume 200 through the heat exchanger, to enable the heat exchanger to provide heating of an air flow directed across the heat exchanger.

The internal volume 200 may be exposed to the transmitter 160 to enable the transmitter 160 to output a wave signal through the internal volume 200. For example, the burner enclosure 152 may include a first opening 204 (e.g., a first hole, a first slot, a first aperture) formed through a first panel 206 of the burner enclosure 152 at the first side 164. The burner enclosure 152 may also include a second opening 208 (e.g., a second hole, a second slot, a second aperture) formed through a second panel 210 of the burner enclosure 152 at the second side 166. The internal volume 200 may be exposed to the transmitter 160 via the first opening 204, and the transmitter 160 may be positioned to output the wave signal through the first opening 204, into the internal volume 200, and toward the second opening 208. The receiver 162 may be positioned to receive the wave signal output by the transmitter 160. Indeed, the internal volume 200 may be exposed to the receiver 162 via the second opening 208 to enable the receiver 162 to capture the wave signal via the second opening 208.

As discussed above, the casings 172, 174 may couple the transmitter 160 and the receiver 162, respectively, to the burner enclosure 152. By way of example, the first casing 172 may position the transmitter 160 to enable the transmitter 160 to output the wave signal through the internal volume 200 via the first opening 204, and the second casing 174 may position the receiver 162 to enable the receiver 162 to receive the wave signal from the internal volume 200 via the second opening 208. Additionally, the casings 172, 174 may position the transmitter 160 and the receiver 162, respectively, to form a gap between the burner enclosure 152 and the transmitter 160 and/or between the burner enclosure 152 and the receiver 162. As such, the transmitter 160 and/or the receiver 162 may not be in direct contact with the burner enclosure 152. Thus, the casings 172, 174 may block direct heat transfer from the burner enclosure 152 to the transmitter 160 and/or the receiver 162. In some embodiments, the casings 172, 174 may include insulation configured to surround the transmitter 160 and/or the receiver 162 to limit heat transfer from the burner enclosure 152 to the casings 172, 174 and from the casings 172, 174 to the transmitter 160 and/or the receiver 162, further limiting heat transfer from the burner enclosure 152 to the transmitter 160 and/or the receiver 162. In this manner, the casings 172, 174 may block an elevated temperature of the burner enclosure 152 from affecting the transmitter 160 and/or the receiver 162 to protect the transmitter 160 and/or the receiver 162.

Figure 7:
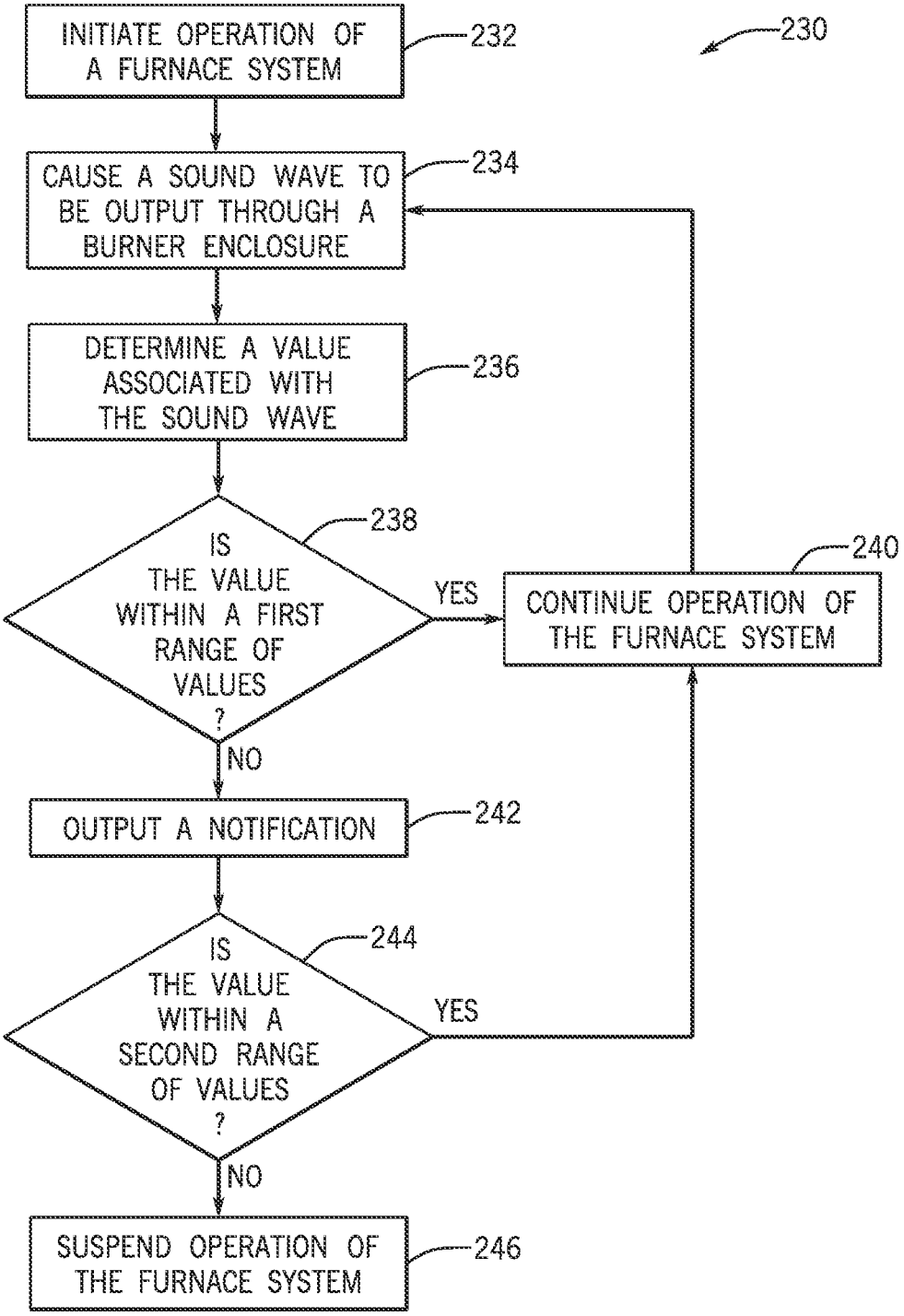
FIG. 7 is a flowchart of an embodiment of a method or process for operating a furnace system, in accordance with an aspect of the present disclosure.

FIG. 7 is a flowchart of an embodiment of a method or process 230 for operating the furnace system 70. In some embodiments, the method 230 and/or one or more of the steps thereof may be performed by a single respective component or system, such as by the wave signal control assembly 171 (e.g., the processing circuitry 170 of the control system 156, the transmitter 160, the receiver 162). In additional or alternative embodiments, multiple components or systems may perform the steps for the method 230. It should also be noted that additional steps may be performed with respect to the method 230. Moreover, certain steps of the method 230 may be removed, modified, and/or performed in a different order.

At block 232, operation of the furnace system 70 may be initiated. By way of example, the operation of the furnace system 70 may be initiated in response to a call for conditioning, which may be received based on a user input and/or based on a detected operating parameter (e.g., a temperature being below a threshold temperature) associated with a space serviced by the furnace system 70. Upon initiating the operation of the furnace system 70, at block 234, a wave signal may be output through the burner enclosure 152. For example, the transmitter 160 may be instructed to output the wave signal. The output wave signal may include a property, such as a frequency, a wavelength, an amplitude, a speed, and/or a strength, that is predetermined and/or preset. However, the property may be adjusted as the wave signal traverses the burner enclosure 152. For instance, the temperature within the burner enclosure 152, the ignition of the fuel/oxidizer mixture within the burner enclosure 152, or any other factor associated with operation of the burner assembly 150 may adjust the property of the wave signal.

At block 236, a value (e.g., a property value of the wave signal, an operating parameter value of the furnace system 70) associated with the wave signal output through the burner enclosure 152 may be determined. By way of example, the wave signal may be received by the receiver 162, data associated with the wave signal may be received from the receiver 162, and the value may be determined based on the data. In some embodiments, the data may directly include the value. For example, the data may directly indicate a wavelength, a frequency, an amplitude, a speed, and/or a strength of the wave signal. In additional or alternative embodiments, the value may be determined, calculated, or derived based on information included in the data. For example, the data may include the wavelength and frequency of a wave signal, and the control system 156 may calculate the speed of the wave signal by multiplying the wavelength by the frequency. In further embodiments, the control system 156 may use the information (e.g., a property value of the wave signal) included in the data to determine an operating parameter value of the furnace system 70, such as a temperature of the burner enclosure 152 and/or a composition of the fuel/oxidizer mixture. As an example, in response to a determination of the property value of the wave signal based on the data, an operating parameter value corresponding to the property value may be determined by referencing stored data or information associating or mapping various property values of the wave signal with corresponding, respective operating parameter values.

At block 238, upon determining the value associated with the wave signal, the value may be compared to a first range of values (e.g., a first range of property values of the wave signal, a first range of operating parameter values of the furnace system 70), which may include a first high threshold value and a first low threshold value. The first range of values may indicate a desirable, target, or expected operation of the burner assembly 150 and may be preset and/or predetermined (e.g., via a calibration mode, during design and/or manufacture of the furnace system 70) prior to operation of the furnace system 70. At block 240, in response to determining the value associated with the wave signal is within the first range of values (e.g., between the first high threshold value and the first low threshold value) and indicates that the operation of the furnace system 70 may be desirable (e.g., a flame of sufficient temperature is present), the furnace system 70 may continue to be operated without performing any additional actions, such as without changing a current operation of the furnace system 70.

However, at block 242, in response to determining that the value associated with the wave signal is outside of the first range of values (e.g., exceeds the first high threshold value, is below the first low threshold value) to indicate that the operation of the furnace system 70 may be undesirable, a notification may be output. The notification may inform a user, such as a technician, an operator, and/or a customer, that the operation of the burner assembly 150 is not desirable. Thus, the notification may prompt the user to perform a mitigation action, such as to inspect the furnace system 70, before the operation of the burner assembly 150 and/or the furnace system 70 becomes faulty. As an example, the notification may be output to a mobile device of the user. As another example, the notification may include a visual output, such as a light, and/or an audio output, such as a sound. In certain embodiments, the control system 156 may also adjust the operation of the furnace system 70 in response to determining that the value associated with the wave signal is outside of the first range of values, such as by adjusting the fuel/oxidizer mixture, adjusting a flow rate of the fuel/oxidizer mixture into the burner enclosure 152, and the like.

After outputting the notification, at block 244, the value associated with the wave signal may also be compared to a second range of values, which may include a second high threshold value and a second low threshold value. The second high threshold value may be greater than the first high threshold value of the first range of values, and the second low threshold value may be less than the first low threshold value of the first range of values. That is, the second range of values may include a greater quantity of values than that of the first range of values, and the first range of values may be included (e.g., nested) within the second range of values. The second range of values may indicate whether the operation of the burner assembly 150 is faulty. As an example, a value associated with the wave signal that is outside of the first range of values but within the second range of values may indicate that the operation of the burner assembly 150 may not be desirable, such as that the operation is below a threshold efficiency (e.g., a flame being produced is not at a sufficient temperature), but the operation of the burner assembly 150 is not faulty or defective. For instance, continued operation of the burner assembly 150 while the value is outside of the first range of values and within the second range of values may still enable the furnace system 70 to provide sufficient heating capabilities. Accordingly, in response to a determination that the value associated with the wave signal is within the second range of values and outside of the first range of values, a current operation of the furnace system 70 may be continued, as described with respect to block 240, upon outputting the notification.

However, at block 246, in response to a determination that the value associated with the wave signal is outside of the second range of values to indicate that the current operation of the burner assembly 150 may be faulty (e.g., no flame is being produced), the operation of the furnace system 70 may be suspended. For instance, the faulty operation of the burner assembly 150 may not enable the furnace system 70 to provide sufficient heating capabilities and/or may limit or affect another operation of a component of the furnace system 70. By way of example, the value being outside of the second range of values may indicate that a flame is not present within the burner enclosure 152, the fuel/oxidizer mixture is not flowing sufficiently into the burner enclosure 152, that the fuel/oxidizer mixture is not being sufficiently ignited, and/or that a mixture or composition of the fuel/oxidizer mixture is not desirable. As such, the operation of the furnace system 70 may be suspended to block further effects of the faulty operation of the burner assembly 150. In certain embodiments, in response to determining that the value is outside of the second range of values and/or while the operation of the furnace system 70 is suspended, an additional notification may be output to prompt a user to perform a mitigation action. Indeed, the operation of the furnace system 70 may continue to be suspended (e.g., operation of the furnace system 70 may not be initiated in response to a call for heating) until a particular action has been performed to address the potentially faulty operation of the burner assembly 150.

It should be noted that during operation of the furnace system 70, certain steps of the method 230 may be continually performed. For example, the wave signal may be output at a predetermined frequency and for each wave signal, and a respective value associated with each wave signal may be determined and compared to the first range of values and/or the second range of values. Thus, the operation of the burner assembly 150 may be constantly evaluated during the operation of the furnace system 70. In such embodiments, a certain type of notification (e.g., a visual output, an audio output) may be output each time a determination is made that a value associated with one of the wave signals is outside of the first range of values and/or the second range of values. Thus, the notification may be repeatedly broadcasted to indicate that a mitigation action is to be performed. However, another type of notification (e.g., a notification transmitted to a mobile device) may not be output each time a determination is made that a value associated with the wave signal is outside of the first range of values and/or the second range of values to avoid overburdening or overwhelming a user. For example, the other type of notification may be output at a particular frequency (e.g., a set quantity per hour) and/or a particular number of times (e.g., at the first instance in which the value is determined to be outside of the first range of values and/or the second range of values) while a determination is made that the value is outside of the first range of values and/or the second range of values. Continual performance of the method 230 during the operation of the furnace system 70 may facilitate identification of an undesirable operation of the burner assembly 150 to enable the undesirable operation to be better mitigated and/or addressed.

Furthermore, in embodiments in which steps of the method 230 are repeated, the wave signal output through the burner enclosure 152 may be adjusted. By way of example, in response to a determination that the value associated with the wave signal is outside of the first range of values and/or the second range of values, a property of a subsequent wave signal for output may be adjusted to verify an undesirable operation of the burner assembly 150. For instance, in response to a determination that the speed of the wave signal is outside of the second range of values (e.g., a difference between the speed of the initially output wave signal and the corresponding speed of the received wave signal indicates an undesirable operation of the burner assembly 150), a new wave signal having a different, new speed may be output to confirm that the burner assembly 150 is not operating desirably (e.g., that the difference between the new speed of the initially output new wave signal and the corresponding speed of the received new wave signal also indicates the undesirable operation of the burner assembly 150). Indeed, a value associated with the new wave signal may be compared to another range of values, such as a third range of values, and in response to the value associated with the new wave signal being outside of the other range of values, the furnace system 70 may be suspended. In this manner, multiple iterations of the method 230 may be performed using wave signals with different properties to verify that a particular action is to be taken before performing such action.

The present disclosure may provide one or more technical effects useful in the operation of an HVAC system. For example, the HVAC system may include a furnace system having a burner assembly as a heat source to enable the furnace system to provide heating capabilities. The burner assembly may include a burner enclosure in which a fuel/oxidizer mixture is directed and ignited to generate heat. The burner assembly may also include a wave signal control assembly that includes a transmitter, a receiver and a control system. During operation of the furnace system, the transmitter may output a wave signal, and the receiver may capture the wave signal. A property of the wave signal may be affected, adjusted, or established based on an operation of the burner assembly, such as a temperature within the burner enclosure. Thus, the control system may analyze the property of the wave signal to determine whether the operation of the burner assembly and therefore of the furnace system is desirable (e.g., a fuel is ignited to produce a flame at a sufficient temperature). As an example, the control system may compare a value associated with the wave signal (e.g., a value of a property of the wave signal, a value of an operating parameter of the furnace system) with a range of values indicative of desirable operation of the burner assembly, such as that a flame of a sufficient temperature is produced within the burner assembly. In response to the value associated with the wave signal being outside of the range of values and indicating that the burner assembly may not be operating desirably, the control system may perform a subsequent action, such as to output a notification and/or to suspend operation of the furnace system. The transmitter and the receiver may be more reliable, durable, and/or accurate than other types of sensors, such as contact sensors configured to directly measure a temperature and/or presence of a flame. As such, utilizing the wave signal output through the burner enclosure may improve monitoring the operation of the burner assembly. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A furnace system of a heating, ventilation, and/or air conditioning (HVAC) system, comprising:

a burner assembly comprising a burner enclosure, wherein the burner enclosure is configured to receive a fuel for ignition to generate heated combustion byproducts; and a controller configured to:

initiate operation of the furnace system in response to receipt of an indication to operate the furnace system;

transmit, via a transmitter, a wave signal through the burner enclosure based on the indication;

detect a value associated with the wave signal transmitted through the burner enclosure; and operate the furnace system based on a comparison between the value and a threshold value.

2. The furnace system of claim 1, wherein the controller is configured to output a notification, suspend operation of the furnace system, or both, in response to a determination that the value exceeds the threshold value.

3. The furnace system of claim 1, wherein the transmitter is coupled to the burner enclosure and communicatively coupled to the controller.

4. The furnace system of claim 3, comprising a receiver coupled to the burner enclosure and communicatively coupled to the controller, wherein the receiver is configured to receive the wave signal output by the transmitter and transmit data associated with the wave signal to the controller.

5. The furnace system of claim 4, wherein the burner enclosure comprises a first opening and a second opening formed therethrough, the transmitter is configured to output the wave signal into the burner enclosure via the first opening, and the receiver is configured to receive the wave signal via the second opening.

6. The furnace system of claim 5, wherein the first opening and the second opening are formed at opposite sides of the burner enclosure.

7. The furnace system of claim 5, comprising a first casing configured to enclose the transmitter and a second casing configured to enclose the receiver, wherein the first casing is configured to position the transmitter relative to the first opening, and the second casing is configured to position the receiver relative to the second opening.

8. A non-transitory computer-readable medium comprising instructions stored thereon, wherein the instructions, when executed by processing circuitry, are configured to cause the processing circuitry to:

receive data associated with detection of a wave signal transmitted through a burner assembly of a furnace system;

determine a value associated with the wave signal based on the data;

determine an operating parameter of the furnace system based on the value;

operate the furnace system based on the operating parameter; and output a notification, adjust operation of the furnace system, or both, based on a determination that the value is outside of a range of values.

9. The non-transitory computer-readable medium of claim 8, wherein the instructions, when executed by the processing circuitry, are configured to cause the processing circuitry to continue a current operation of the furnace system in response to a determination that the value is within the range of values.

10. The non-transitory computer-readable medium of claim 8, wherein the range of values is a first range of values, and the instructions, when executed by the processing circuitry, are configured to cause the processing circuitry to:

compare the value associated with the wave signal with a second range of values, wherein the second range of values includes the first range of values; and suspend operation of the furnace system in response to a determination that the value is outside of the second range of values.

11. The non-transitory computer-readable medium of claim 10, wherein the instructions, when executed by the processing circuitry, are configured to cause the processing circuitry to continue a current operation of the furnace system upon outputting the notification in response to a determination that the value associated with the wave signal is outside of the first range of values and within the second range of values.

12. The non-transitory computer-readable medium of claim 8, wherein the value is associated with a frequency, a wavelength, an amplitude, a speed, a strength, or any combination thereof of the wave signal.

13. The non-transitory computer-readable medium of claim 8, wherein the operating parameter comprises a presence of a flame within a burner enclosure of the burner assembly, a temperature within the burner enclosure, a quality of fuel received by the burner enclosure, a composition of the fuel, a flame speed, a burning velocity, an upper flammability limit, a lower flammability limit, a flame period, a flame length, a flame position, a flame shape or geometry, a heat flux, a flame angle, a redox characteristic of a flame, or any combination thereof.

14. A furnace system, comprising:

a burner enclosure forming an internal volume;

a transmitter coupled to the burner enclosure, wherein the transmitter is configured to output a wave signal into the burner enclosure;

a receiver coupled to the burner enclosure, wherein the receiver is configured to receive the wave signal output by the transmitter; and a controller communicatively coupled to the receiver and to the transmitter, wherein the controller is configured to:

initiate operation of the furnace system in response to receipt of an indication to operate the furnace system;

transmit, via the transmitter, the wave signal through the burner enclosure based on the indication;

receive data from the receiver, wherein the data comprises a property value associated with the wave signal; and operate the furnace system based on the property value.

15. The furnace system of claim 14, wherein the wave signal comprises a sound wave.

16. The furnace system of claim 14, wherein the property value comprises a frequency value, a wavelength value, a speed value, an amplitude value, or any combination thereof of the wave signal.

17. The furnace system of claim 14, wherein the transmitter, the receiver, or both are positioned external to the internal volume of the burner enclosure.

18. The non-transitory computer-readable medium of claim 8, wherein the instructions, when executed by the processing circuitry, are configured to cause the processing circuitry to adjust the operation of the furnace system and, to adjust the operation of the furnace system, the instructions, when executed by the processing circuitry, are configured to cause the processing circuitry to adjust a fuel/oxidizer mixture within a burner enclosure of the furnace system or adjust a flow rate of the fuel/oxidizer mixture into the burner enclosure.

* * * * *